US009885235B2

(12) United States Patent
Xia et al.

(10) Patent No.: US 9,885,235 B2
(45) Date of Patent: Feb. 6, 2018

(54) MULTI-PHASE FLUID FLOW PROFILE MEASUREMENT

(71) Applicant: HALLIBURTON ENERGY SERVICES, INC., Houston, TX (US)

(72) Inventors: Hua Xia, Huffman, TX (US); Robert Atkinson, Conroe, TX (US); Christopher Michael Jones, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 231 days.

(21) Appl. No.: 14/650,412

(22) PCT Filed: Dec. 27, 2013

(86) PCT No.: PCT/US2013/077965

§ 371 (c)(1),
(2) Date: Jun. 8, 2015

(87) PCT Pub. No.: WO2015/099762

PCT Pub. Date: Jul. 2, 2015

(65) Prior Publication Data

US 2016/0097273 A1 Apr. 7, 2016

(51) Int. Cl.
*E21B 47/10* (2012.01)

(52) U.S. Cl.
CPC ..... *E21B 47/1005* (2013.01)

(58) Field of Classification Search
CPC ..... E21B 47/1005
See application file for complete search history.

(56) References Cited

U.S. PATENT DOCUMENTS 3,454,094 A * 7/1969 Friedman ..... E21B 43/20 166/250.01
4,343,181 A * 8/1982 Poppendiek ..... E21B 47/065 374/136
4,435,978 A * 3/1984 Glatz ..... E21B 47/10 166/250.01
4,570,715 A * 2/1986 Van Meurs ..... E21B 19/22 166/302
4,616,705 A * 10/1986 Stegemeier ..... E21B 19/22 166/250.01
4,621,929 A * 11/1986 Phillips ..... A61B 5/028 356/44
4,701,712 A * 10/1987 Seeley ..... G01V 3/18 324/224

(Continued)

OTHER PUBLICATIONS

International Patent Application No. PCT/US2013/077965 , International Search Report and Written Opinion, dated Sep. 22, 2014, 14 pages.

*Primary Examiner* — David Bolduc
(74) *Attorney, Agent, or Firm* — Kilpatrick Townsend & Stockton LLP

(57) ABSTRACT

Described herein are devices, systems, and methods for analyzing multi-phase fluid flow profile and flow field distribution by utilizing heating wires and thermal sensing arrays to detect transient thermal response and generate a dynamic temperature profile. The thermal sensing arrays include a plurality of thermal sensors disposed linearly along the length of the array. The multi-point dynamic temperature profile is used to determine fluid rate, velocity, flow patterns, and flow field distribution.

22 Claims, 8 Drawing Sheets

(56) References Cited

U.S. PATENT DOCUMENTS 4,832,121 A * 5/1989 Anderson ..... E21B 43/26 166/250.09
5,159,569 A * 10/1992 Xu ..... E21B 47/065 374/136
5,509,474 A * 4/1996 Cooke, Jr. ..... E21B 47/1005 166/250.01
5,551,287 A * 9/1996 Maute ..... E21B 47/01 166/250.01
5,610,331 A * 3/1997 Georgi ..... E21B 47/065 166/250.01
5,782,301 A * 7/1998 Neuroth ..... H05B 3/56 166/302
6,227,045 B1 * 5/2001 Morse ..... E21B 47/1005 166/264
6,497,279 B1 * 12/2002 Williams ..... E21B 36/04 166/250.01
6,807,324 B2 * 10/2004 Pruett ..... G01K 15/002 374/E11.015
7,412,881 B2 * 8/2008 Crawley ..... E21B 47/1005 73/152.33
7,639,016 B2 12/2009 Forgang
8,230,732 B2 7/2012 Maute
8,312,767 B2 11/2012 Maute
8,579,504 B2 * 11/2013 Koeniger ..... E21B 33/035 374/112
8,783,355 B2 * 7/2014 Lovell ..... E21B 47/1005 166/250.01
9,341,034 B2 * 5/2016 Bujold ..... E21B 17/20
2003/0122535 A1 7/2003 Williams et al.
2003/0236626 A1 * 12/2003 Schroeder ..... G01K 11/32 702/6
2006/0117844 A1 * 6/2006 Birkle ..... G01F 1/688 73/204.23
2008/0317095 A1 * 12/2008 Hadley ..... E21B 36/04 374/137
2009/0107231 A1 * 4/2009 Bosselmann ..... G01P 5/10 73/170.12
2009/0165551 A1 * 7/2009 Bosselmann ..... G01F 1/6884 73/204.23
2011/0125451 A1 5/2011 Cheifetz et al.
2011/0232377 A1 9/2011 Sierra
2011/0284217 A1 11/2011 Brown
2012/0010846 A1 * 1/2012 Brian ..... G01F 23/22 702/134
2012/0180548 A1 * 7/2012 Bosselmann ..... G01F 1/6884 73/23.31
2012/0186570 A1 * 7/2012 Bosselmann ..... G01F 1/6884 123/703
2013/0087723 A1 * 4/2013 Pelletier ..... H01J 63/00 250/504 R
2013/0214934 A1 8/2013 Smart
2014/0110105 A1 * 4/2014 Jones ..... E21B 47/10 166/250.01
2014/0144226 A1 * 5/2014 Shanks ..... E21B 47/065 73/152.31
2014/0290335 A1 * 10/2014 Shanks ..... E21B 47/1005 73/25.05
2015/0007984 A1 * 1/2015 Donderici ..... E21B 47/09 166/250.01
2015/0135817 A1 * 5/2015 Moscato ..... E21B 47/00 73/152.33

* cited by examiner

MULTI-PHASE FLUID FLOW PROFILE MEASUREMENT

CROSS-REFERENCE TO RELATED APPLICATIONS

This is a U.S. national phase under 35 U.S.C. § 371 of International Patent Application No. PCT/US2013/077965, titled "Multi-Phase Fluid Flow Profile Measurement" and filed Dec. 27, 2013, the entirety of which is hereby incorporated by reference herein.

TECHNICAL FIELD

This application relates generally to multi-phase fluid flow measurement and more specifically to devices, systems, and methods for analyzing flow profiles and related properties of multi-phase fluids from a downhole or reservoir environment.

BACKGROUND

Accurate analyses of fluid flow, including distinguishing between single and multi-phase flow, evaluating flow properties, and determining fluid velocity profile and viscosity, are important in evaluating production efficiencies of oil and gas wells and optimizing that production process. Fluid in a hydrocarbon producing wellbore often exhibits multi-phase flow characteristics because gaseous and aqueous hydrocarbons may be produced from different zones. Often the fluid is a system of two immiscible fluids, e.g., hydrocarbon and water. The hydrocarbon may be present in a greater amount with the water distributed in a lesser amount, or vice versa. Multi-phase flow often exhibits two-phase flow patterns such as water-gas or oil-gas. Other flow patterns may exhibit three-phase (gas, liquid, and solid) or other emulsion and/or turbulent related multi-phase flow patterns. With detailed understanding of the flow, skilled persons can adjust process parameters to control production efficiency from different zones in a wellbore.

Existing flow measurement techniques are designed for single-phase volumetric or mass flow detection, but their measurement accuracy is greatly affected by potential multi-phase fluid properties related to flow field distribution and fluid velocity. This is critical because many fluids have different flow regimes, such as laminar or turbulent flow. Laminar flow occurs where viscous forces are dominant over inertial forces and is characterized by smooth, constant fluid motion. Turbulent flow is dominated by inertial forces which tend to produce chaotic eddies, vortices and other flow instabilities. The Reynolds number (Re) is a measure of the ratio of inertial forces to viscous forces and is high for turbulent flow and lower for laminar flow. For example, in the case of flow through a straight pipe with a circular cross-section, laminar flow typically occurs where $Re<2040$ and flow can be turbulent at $Re>2040$. In extreme cases $Re<<1$ and fluid flow is highly viscous. Such viscous fluid flow often is referred to as Stokes flow. Existing flowmeters cannot account for different flow regimes within a fluid.

Moreover, multi-phase fluids exhibit flow field distributions and velocity profiles even more complex than those of single-phase fluids. Examples of multi-phase flow patterns include bubbly flow, slug flow, churn flow, annular flow, and combinations thereof. For single phase fluid flow, the best accuracy in measuring volumetric flowrate is about 3-5 percent. For multi-phase fluid flow that accuracy is degraded even to 20-25 percent. Under downhole harsh conditions of $T>100°$ C. and $P>10$ kpsi, the hydrocarbon fluid phase is more or less described by equation of state (EoS). Whether a hydrocarbon fluid is in a liquid phase or in a gas phase depends upon the pressure and temperature, and in a specific case, liquid and gas phases may co-exist when the pressure is lower than its bubble point or dew point.

Despite advancements in fluid flow detection techniques (such as ultrasonic, magnetic, optic, mechanical, etc.), flowrate detection in mixed phases, especially immiscible fluids, still represents a great challenge. It often happens that apparent, erratic volumetric detections are attributed to low flowmeter accuracy, but careful study reveals that these flowmeters actually give volumetric flowrate without considering the complicated nature of the multi-phase fluid flow formation that can vary among laminar, turbulent, and Stokes flow. If this multi-phase behavior is not considered, determining the fluid type and actual flow rate can be difficult. It is thus an object of the present disclosure to provide devices, systems, and methods for accurate multi-phase fluid flow profile measurement.

BRIEF DESCRIPTION OF THE DRAWINGS

The accompanying drawings, which are included to provide a further understanding of the inventive technology and are incorporated in and constitute a part of this specification, illustrate various embodiments of the inventive technology and together with the description serve to explain the principles and concepts of the technology. In the drawings.

Figure 1:
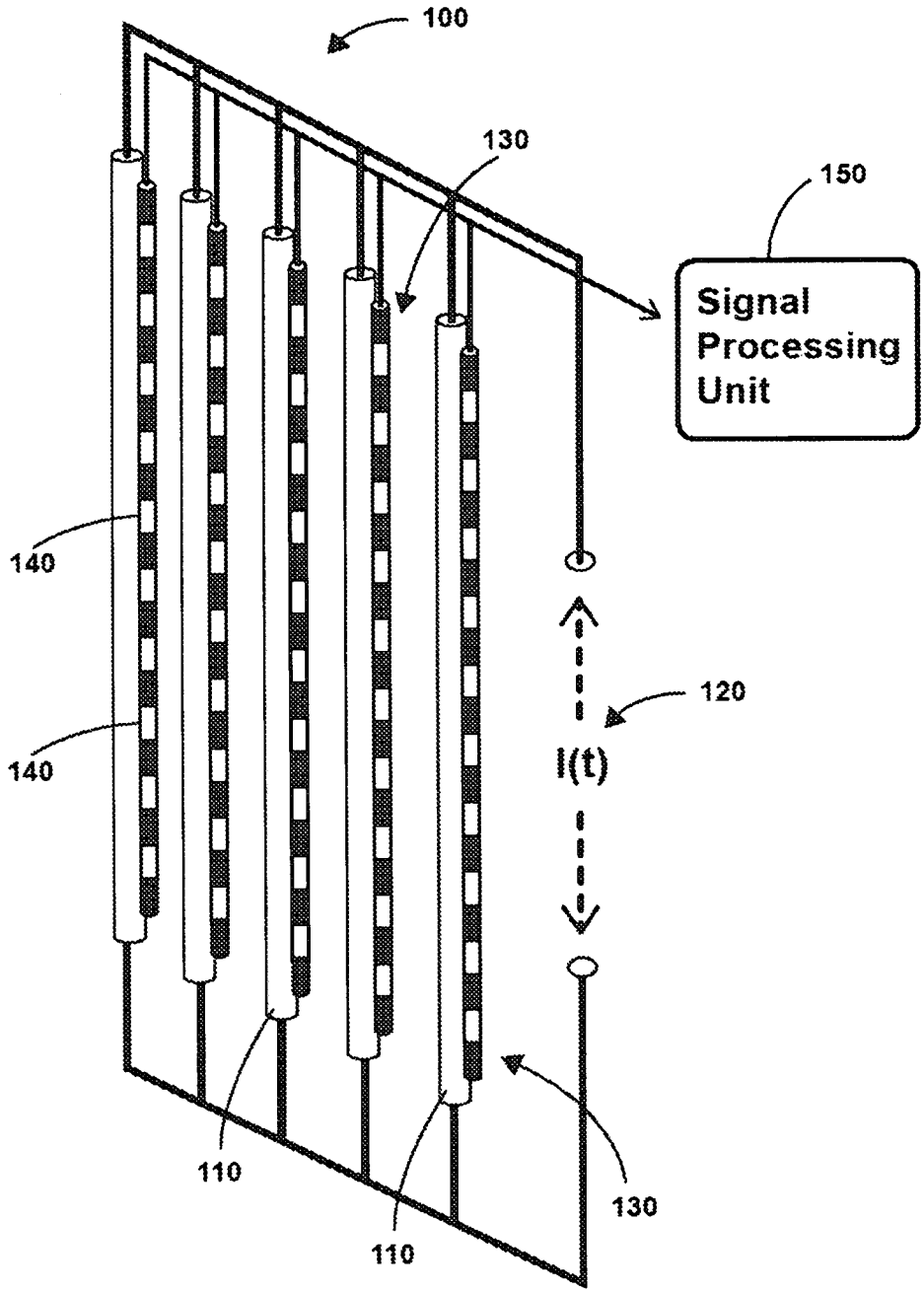
FIG. 1 is an illustration of an embodiment of a sensor package as described herein.

The figures referred to above are not drawn necessarily to scale and should be understood to present representations of embodiments and illustrations of the principles involved.

DETAILED DESCRIPTION

Described herein are devices, systems, and methods of measuring multi-phase fluid flow profile and field distribution. Methods described herein utilize thermal sensing arrays to detect transient thermal response profiles across a fluid wave front and along the direction of fluid flow or/and perpendicular to fluid flow direction. The thermal sensing array includes a plurality of thermal sensors disposed linearly adjacent to the length of the heating element, or other heating mechanism. The thermal sensing arrays may be integrated with the heating element as one package. In one case as a fluid flows, the heating elements heat the fluid by thermal conduction, and the thermal sensing arrays detect dynamic thermal profiles along the flow line or fluid streamline. In another case, as a fluid flows, the pulsed external heat energy heats a high thermal conductive grid, and the thermal sensing arrays detect thermal profiles of the grid from different grid sections. The plurality of sensing arrays may detect an axial thermal response and/or a radial thermal response. The thermal sensors may have a spatial separation from 10 cm to 50 cm, and with 10-20 sensors in each sensing array. Depending upon the pipeline or conduit diameter the number of the arrays in a radial direction may range from 3 to 15.

The axial dynamic thermal profile reflects the fluid velocity, and the radial dynamic thermal profile reflects the differences among multiple thermal sensing arrays and is related to the flow velocity field distribution. The heating elements may be heated by short bursts of electric energy, for example pulse current modulated excitation, and the thermal sensors of the plurality of sensing arrays respond to transient fluid temperature change as the fluid flows. Each of these sensors will record a baseline temperature variation of the flowing fluid and a short time-dependent temperature dynamic variation that is a result of the short pulse temperature burst event introduced to the fluid by the heating wire. Each of the sensing arrays will show a different thermal dynamic response that depends upon the sensing array location and fluid type. In one case a radiative heating burst using microwave or laser light may be used to pulse heat to the fluid. Also a burst of radiation may be selected, turned, or optimized for different fluid phases.

Some embodiments described herein are downhole formation fluid flowing characteristics detection techniques. The devices, systems, and methods described herein for the first time present a practical solution for detecting various fluid flowing characteristics by measuring fluid field distribution and fluid profile that potentially enable us to improve existing downhole multi-phase fluid flowrate measurement accuracy from 20-25% to a customer acceptable range, for example, an accuracy corresponding to single-phase flow rate measurement. In some embodiments, devices, systems, and methods described herein also provide not only a production logging tool for real-time well production condition fluid rate monitoring and diagnosis but also a flow sensing device for petrochemical and refinery industrial process any fluid flow analyses.

While the present disclosure is capable of being embodied in various forms, the description herein of several embodiments is made with the understanding that the present disclosure is to be considered as an exemplification of the disclosure, and is not intended to limit the disclosure to the specific embodiments illustrated. Components illustrated in connection with any embodiment may be combined with components illustrated in connection with any other embodiment.

Certain aspects and embodiments described herein relate to devices and assemblies capable of being disposed in a downhole, such as a wellbore, of a subterranean formation. An assembly according to some embodiments may also or instead be disposed in a pipe, conduit, or any other confined space for fluid flow. The orientation, and thus the direction of bulk fluid flow, of any such wellbore or conduit is not limited, but may be horizontal, vertical, tilted or any direction in between.

Accordingly, in one embodiment, the disclosure is directed to a system for analyzing a fluid flowrate, velocity, and flow patterns, the sensing system including a sensor package that includes a plurality of heating wires and a plurality of thermal sensor arrays, wherein each thermal sensing array includes a plurality of thermal sensing devices aligned linearly along a length of the array, and wherein the thermal sensing devices are configured to detect a dynamic thermal profile along the direction of bulk fluid flow. In that embodiment, in use, the thermal sensing arrays are immersed in a fluid adjacent to the heating wires but electrically insulated from the heating wire aligned with the direction of bulk fluid flow. The direction of bulk fluid flow means, for example, the direction defined by the two ends of a substantially straight conduit, or a substantially straight section of conduit, through which the fluid flows, and typically is parallel to the center axis of the conduit. The thermal differences from each thermal sensor along an array will be proportional to fluid velocity, and perturbed by different flow patterns. The transient temperature response amplitude or difference from the baseline is more related to laminar flow pattern.

In another embodiment, the disclosure is directed to a system for analyzing a fluid flowrate, velocity and flow patterns, the sensing system including a sensor package including a plurality of heating wires and a plurality of thermal sensor arrays, wherein each thermal sensing array includes a plurality of thermal sensing devices aligned linearly along a length of the array, and wherein the thermal sensing devices are configured to detect a dynamic thermal profile perpendicular to the direction of fluid flow. In that embodiment, in use, two or more thermal sensing arrays are immersed in a fluid perpendicular to the direction of bulk fluid flow. The thermal differences, $\Delta T$, of sensors at two sensing locations will be proportional to flow rate and velocity, and also perturbed by flow patterns. In also another embodiment an infrared emission can be used to sense fluid temperature. Rotational molecular vibrational spectra may relate to a fluid phase. Such a radiation would be detected through a transient portion of the fluid flow path.

In still another embodiment, in use, one or more thermal sensing arrays are immersed in a fluid at an orientation tilted, or intermediate between parallel and perpendicular, with respect to the direction of bulk fluid flow. The thermal differences, $\Delta T$, of sensors at two sensing locations will be proportional to flow rate, and also perturbed by flow patterns.

Depending upon the sensing array installation method, namely, vertical or horizontal or titled, the thermal sensor response from each sensing array will be different. In one embodiment, a thermal sensor may have very quick temperature response characteristics during the external heat energy burst moment where the fluid thermal conductivity is low. On the contrary, in another embodiment, a thermal sensor may have a small temperature response characteristic during the external heat energy burst moment, where the fluid thermal conductivity is high. In one embodiment where the sensing array is in a gas phase, a thermal sensor may exactly follow the heating wire modulation pattern. In another embodiment, a thermal sensor may have a very noisy or fluctuating temperature response characteristic during an external heat energy burst moment, for example where the sensing array is in a multi-phase fluid patterns.

In some embodiments, the fluid flow is in a multi-phase fluid pattern. In one embodiment the fluid flow is in a two phase fluid pattern. In another embodiment the fluid flow is in a three-phase fluid pattern. In still another embodiment the fluid is an emulsion and/or has a turbulent flow. In some embodiments, the fluid flow may comprise complicated fluid patterns, such as aforementioned bubbly flow, slug flow, churn flow, annular flow and any combination of the foregoing.

Heating elements in embodiments described herein may be heating wires made of any thermally conductive and electrically resistive material but preferably are, or include, metal. Suitable metals include, but are not limited to, platinum (Pt), Pt-alloys, tungsten (W), and W-alloys. A preferred heating wire may be protected with an electric insulating protecting layer for its application in the electric conductive fluid environment. This protecting layer may be a polymeric material, such as, but not limited, polytetrafluoroethylene (PTFE), polyimide (PI), polyetherketone (PEEK), and combinations thereof. In one embodiment, the protecting material may have a thickness of 0.1 micrometer to 20 micrometers. In another embodiment, the protecting material may have a thickness of 0.1 micrometer to 10 micrometers.

In some embodiments, the protecting layer may include multiple layers of the same or different polymeric materials. In one embodiment, a multilayered protecting layer with the aforementioned polymers may have a thickness of 0.1 micron meters to 20 micron meters. A multilayered protecting layer may have a structure of $(\text{-AB-})_n$, or may have a structure $(\text{-ABC-})_n$, where A, B, and C each represent a polymeric material, for example, PTFE, PI, or PEEK, and where n is any number from one to 20. Of course, there is no limit on suitable polymeric materials and they may include other insulating polymers. In addition, in one embodiment, the outer layer surface may be of either hydrocarbon-phobic or of hydro-phobic nature for preventing deposits and scaling on the heating wires.

Heating wires in embodiments described herein heat the surrounding fluid flow. The heating wires may be heated by any suitable method known to one skilled in the art, but preferably are heated by applying electric energy. The energy may be supplied by a source external to the wellbore or conduit in which the sensor package is disposed. In one embodiment, the thermal energy is provided by a pulse modulated electric current. In another embodiment, the heating wires receive short bursts of energy from transient current excitation. The pulsed pattern may be used to lock in amplifier for small thermal signal process.

The sensing devices in embodiments described herein may be any device capable of detecting a change in fluid properties such as temperature, pressure, phase, etc. but preferably are capable of detecting a thermal response profile along the sensing array. Suitable thermal sensors include thermocouple (TC) sensors, resistivity temperature detectors (RTD), platinum resistivity detectors (PRT), fiber Bragg grating-based sensors, and/or optical time domain (OTDR)-based Brillouin distributed fiber temperature sensors with centimeter spatial resolution. Specifically, fiber sensors from Micron Optics or from OZ Optics are preferred because of their small size and intrinsic insulating properties.

In embodiments described herein, the heating wires are aligned parallel to each other. In some embodiments, the heating wires are aligned parallel to the central axis of the wellbore or conduit in which the assembly is disposed and parallel to the direction of bulk fluid flow. In other embodiments, the heating wires are aligned perpendicular to the center axis of the wellbore or conduit and perpendicular to the direction of bulk fluid flow. In still other embodiments, the heating wires are aligned at an orientation tilted with respect to the direction of bulk fluid flow, or at an orientation intermediate between perpendicular and parallel to the direction of bulk fluid flow.

In one embodiment, some or all of the heating wires in the sensor package lie in a single plane. In one embodiment, at least three heating wires are aligned parallel to each other and lie in a single plane in a symmetric installation package. In another embodiment, the heating wires are attached to a highly thermally conductive metal grid, such as copper, aluminum, Inconel, stainless steel etc. that could provide mechanical support to survive high flowing conditions.

In embodiments described herein, the thermal sensing arrays are aligned parallel to each other. In some embodiments, the thermal sensing arrays are aligned parallel to the central axis of the wellbore or conduit in which the assembly is disposed and parallel to the direction of bulk fluid flow. In other embodiments, the thermal sensing arrays are aligned perpendicular to the center axis of the wellbore or conduit and perpendicular to the direction of bulk fluid flow. In still other embodiments, the thermal sensing arrays are aligned at an orientation tilted with respect to the direction of bulk fluid flow, or at an orientation intermediate between perpendicular and parallel to the direction of bulk fluid flow.

In one embodiment, some or all of the thermal sensing arrays lie in a single plane. In one embodiment, at least three thermal sensing arrays are aligned parallel to each other and lie in a single plane. In another embodiment, the sensing arrays are attached to highly thermal conductive metal grid, such as copper, aluminum, Inconel, stainless steel etc. that could provide mechanical support to survive high flowing conditions.

In some embodiments, the heating wires and thermal sensing arrays are aligned parallel to each other and lie in a single plane. In some embodiments, the heating wires and thermal sensing arrays are aligned parallel to each other with the heating wires in one plane and the thermal sensing arrays in a parallel plane. In some embodiments, each thermal sensing array is aligned parallel to and adjacent to a heating wire. In some embodiments the thermal sensing arrays are integrated with the heating wire metal grid as aforementioned. In some embodiments, each heating wire is sealed within a small thermal conductive tube with one thermal sensing array. A plurality of such thermal conductive tubes is aligned parallel to each other and lies in a single plane.

In some embodiments, the sensor packages are constructed by forming a heating wire grid frame and integrating the thermal sensors with the heating wire grid. In some embodiments, the heating wire grid is connected to an external current, such as a pulse modulated electric current, for raising grid temperature, and the thermal sensing arrays are connected to a signal processing unit for data processing and display. The material for such a heating wire grid is preferred to be Pt and Pt-alloys or W or W-alloys.

FIG. 1 is an illustration of one embodiment of a sensor package 100 as described herein. Heating wires 110 are connected to a pulsed current 120 for transient thermal excitation. Thermal sensing arrays 130 lie adjacent to the heating wires 110 and include a plurality of thermal sensors 140. The thermal sensing arrays 130 are connected to a signal processing unit 150. Other configurations are possible for a sensor package consistent with the disclosure herein.

In some embodiments described herein, a sensing system for analyzing a fluid flowrate or velocity includes two or more sensor packages, each sensor package includes a plurality of heating wires and a plurality of thermal sensing arrays, or a heating wire grid and thermal sensing array integrated package. In embodiments the heating wires and thermal sensing arrays of a first sensor package are aligned parallel with each other and in the same or parallel planes, the heating wires and thermal sensing arrays of a second sensor package are aligned parallel with each other and in the same or parallel planes, and the heating wires and the thermal sensing arrays of the first sensor package are in different planes from the heating wires and thermal sensing arrays of the second sensor package. In some embodiments, the heating wires of the first sensor package and the heating wires of the second sensor package are in planes orthogonal to each other.

In some embodiments, a sensing system for analyzing a fluid flow rate includes a housing surrounding the one or more sensor packages. The housing is open, or has openings, at opposite ends to allow fluid to flow through the housing. In some embodiments, the sensor packages are positioned within the housing such that in use the heating wires and thermal sensing arrays are aligned parallel to the direction of bulk fluid flow. In other embodiments, the sensor packages are installed in a pipe or conduit perpendicular to the direction of the bulk fluid flow.

In use, a sensing system as described herein may be placed in any conduit for analyzing fluid flow therethrough. In some embodiments the conduit is a subterranean wellbore or well casing. In some embodiments the conduit is a pipe. In some embodiments, a housing surrounding one or more sensor packages is secured to the conduit. In some embodiments the sensing system is movable, such that the sensing system can be placed in one location in the conduit and easily moved to another location in the conduit to analyze fluid flow throughout the conduit. In another embodiment a sensing system may integrate several heating wire grids and sensing array integrated sub-systems.

Figure 2:
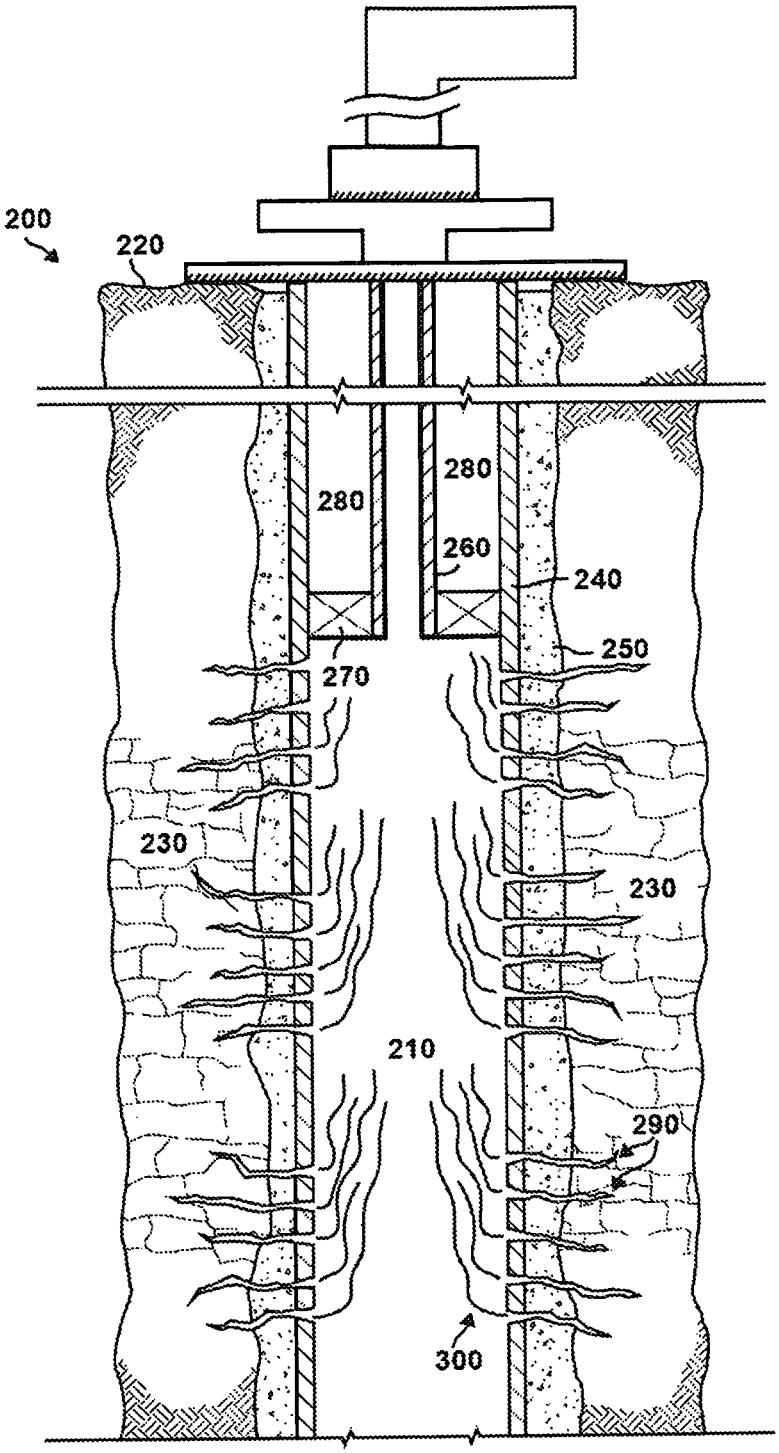
FIG. 2 is an illustration of fluid flow through a wellbore in which a sensor package as described herein may be disposed.

FIG. 2 illustrates fluid flow through a wellbore 200 in which a sensor package as described herein may be disposed. Well construction involves drilling a hole or borehole 210 in the surface 220 of land or ocean floor. The borehole 210 may be several to ten thousand feet deep. Fluids such as oil, gas and water reside in porous rock formations 230. A casing 240 is normally lowered into the borehole 210. The region between the casing 240 and rock formation 230 is filled with cement 250 to provide a hydraulic seal. Usually, tubing 260 is inserted into the hole 210, the tubing 260 includes a packer 270 which comprises a seal. A packer fluid 280 is disposed between the casing 240 and tubing 260 annular region. Perforations 290 may extend through the casing 240 and cement 250 into the rock 230, as shown. Fluid 300 flows out of the rock 230 through the perforations 290 in the wellbore 210.

The present disclosure also encompasses methods of analyzing a fluid flowrate or velocity. The fluid flow may be in single phase or in multi-phase fluid patterns. One such method includes raising the temperature of a plurality of heating wires, wherein the plurality of heating wires is located in a fluid stream having a bulk flow in a single direction, and wherein the heating wires are oriented parallel to each other and are aligned with the direction of the bulk fluid flow; detecting a plurality of temperatures with a plurality of thermal sensing arrays, wherein each thermal sensing array includes a plurality of thermal sensing devices aligned linearly along the thermal sensing array, wherein the thermal sensing arrays are located in the fluid, and wherein the thermal sensing arrays are oriented parallel to each other and are aligned with the direction of the bulk fluid flow; and using the plurality of temperatures to determine a dynamic temperature profile of the fluid. While the bulk fluid flow is in a single direction, local fluid flow at any point in the conduit may be in any direction and could be in multiple directions, especially for turbulent flow. The temperatures detected by the thermal sensing arrays may be absolute or relative temperatures. The dynamic temperature profile may include, but is not limited to, an axial dynamic temperature profile and/or a radial dynamic temperature profile.

In some embodiments, raising the temperature of the plurality of wires includes applying electric current to the wires. In some embodiments, the electric current is a pulse modulated excitation where a short pulse of the current is sent to heating wire. The pulse width ranges from a few microseconds to a few seconds, depending upon the fluid thermal conductivity properties. The thermal sensors are operated at a typical working bandwidth of 100-1000 Hz for detection data rate. In one embodiment the detection data rate of 1 kHz is used for high thermal conductive hydrocarbon fluid flow analyses, in another embodiment the detection data rate of 10-100 Hz is used for lower thermal conductive hydrocarbon fluid analyses. The resulting temperature increase from its baseline temperature, $\Delta T$, should be 5-10 times higher than the baseline temperature deviation.

In some embodiments, measuring multi-point temperatures, or a plurality of temperatures, includes measuring a transient thermal response from all the thermal sensors. In some embodiments, detecting multi-point temperatures, or a plurality of temperatures, and using the multi-point temperatures, or plurality of temperatures, to determine a dynamic temperature profile includes receiving signals from the plurality of thermal sensing arrays at a signal processing unit and displaying the dynamic temperature profile. In some embodiments, the dynamic temperature profile is displayed in real time by converting measured electronic signals from each electric thermal sensor, or optical signals from fiber sensors.

In embodiments disclosed herein, a dynamic temperature profile may be used to determine a flow field distribution. For example, a temperature difference at any location as measured by the thermal sensing arrays is proportional to the difference in fluid velocity at that location. In some embodiments, the flow radial field distribution may be correlated with a fluid viscosity property that reflects the degree of the friction from liquid and solid surface. The flow velocity could be close to zero in viscous fluid case, and non-zero for dilute or lower viscous fluids.

FIGS. 3*a-d* illustrate one embodiment of a system and method as described herein. FIG. 3*a* illustrates laminar flow through a conduit 400. The arrows 410 represent the velocity of the fluid at different points across the conduit 400. Fluid flow has the highest velocity in the center of the conduit and that velocity decreases from the center 420 to the walls 430 of the conduit. A laminar flow profile will resemble the graph in FIG. 3*b*, where y is distance from the center 420 to a wall 430 of the conduit 400 and v represents flow velocity.

FIG. 3*c* illustrates a sensor package 450 including heating wires 460 and thermal sensing arrays 470 including a plurality of thermal sensors 480, as described herein positioned inside the conduit 400 and aligned in the direction of bulk fluid flow. Methods of the present invention may be used to apply heat to the fluid at various points across the conduit 400. In laminar flow, the flow in the center of the conduit 400 is faster than the flow at the walls 430. As shown in FIG. 3*d*, the temperature of the fluid in the center of the conduit 400 will not rise as much as the temperature of the fluid near the walls 430 because the fluid in the center of the conduit 400 may dissipate more heat energy than the area close to wall.

The flow temperature profile shown in FIG. 3*d* has a slope across a sensing array 470 with the temperatures of the left-side sensors 480 lower than the right-side sensors 480 because of the thermal energy dissipation in the flowing fluid. In a zero fluid velocity case, there would be no temperature slope for a sensing array measured thermal profile. Furthermore, the slope is more or less proportional to fluid velocity and can be used as an indicator of the fluid velocity field distribution across a radial axis. After the fluid is heated, the temperature will decrease more quickly in the center than at the walls 430. Thus, both the relative temperatures across a cross-section of conduit and the relative slopes of a line representing temperature over the length of the thermal sensing array provide information relevant to the fluid velocity profile. A thermal sensing array as described herein and illustrated in FIG. 3*c* can detect the temperature changes across the fluid.

A pulse modulated current can be used as the energy source to excite the transient thermal event. The energy imparted to the fluid can be detected simultaneously by the thermal sensing arrays. The thermal sensor signals may be sent to a signal process unit for data processing and display. For a specific case such as turbulent flow, the dynamic temperature profile across each thermal sensing array will be similar to the other thermal sensing arrays. Laminar flow, however, will result in a different transient thermal profile for different thermal sensing arrays.

In some embodiments, transient thermal sensing arrays will show thermal profiles across a length of the sensor package. In some embodiments, the sensor package is a grid-like frame that can be inserted into a conduit cross-section. In some embodiments, the conduit may be a pipe or a wellbore casing. In some embodiments the system is movable, such that the system can be placed in one location in the conduit and easily moved to another location in the conduit to analyze fluid flow throughout the conduit.

In some embodiments, a measured flow velocity field distribution or profile can be correlated with fluid viscosity properties that also can be measured directly by a densitometer/viscometer. For example, high viscosity could greatly reduce fluid velocity or the flowrate and also reduce hydrocarbon production and efficiency.

Figure 3:
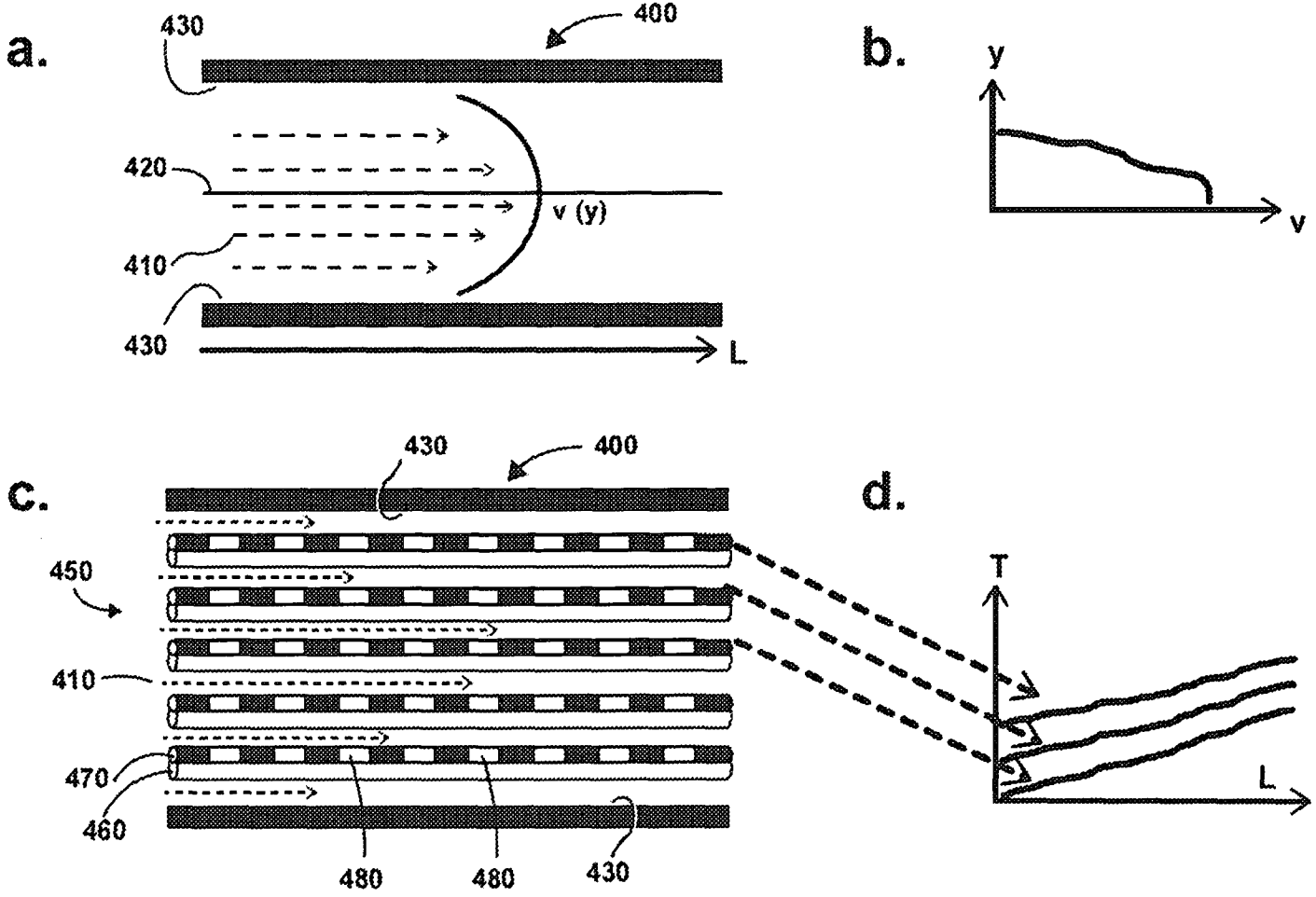
FIG. 3*a* is an illustration of a fluid exhibiting laminar flow through a conduit.
FIG. 3*b* is a graph representative of a flow velocity profile of the fluid in FIG. 1*a*.
FIG. 3*c* is an illustration of an embodiment of a thermal sensor array as described herein located in the fluid in FIG. 1*a*.
FIG. 3*d* is a graph representative of a thermal profile of the fluid in FIG. 1*a*.

FIG. 3 illustrates embodiments of the systems and methods disclosed herein with respect to laminar flow through a conduit, but the disclosed systems and methods also are applicable to quasi-laminar, turbulent, and multi-phase flow. FIGS. 4*a-f* are graphs of temperature profiles and flow velocity profiles for laminar, quasi-laminar, and turbulent flow through a conduit using devices, systems, and methods disclosed herein.

Figure 4:
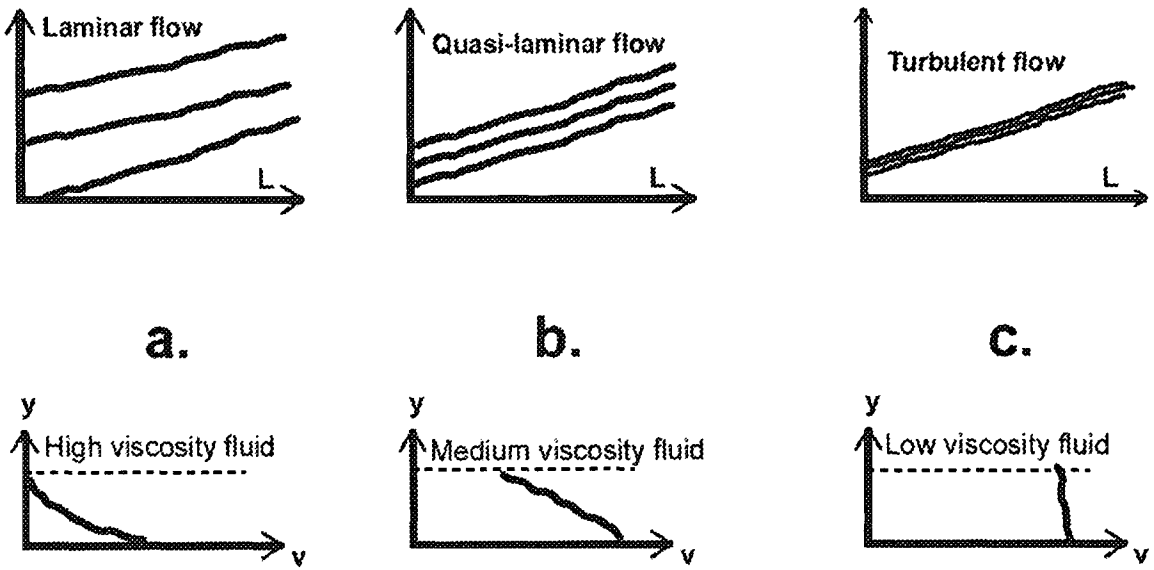
FIGS. 4*a-c* are graphs representative of thermal profiles of fluids exhibiting laminar flow (a), quasi-laminar flow (b), and turbulent flow (c).
FIGS. 4*d-f* are graphs representative of flow velocity profiles of fluids exhibiting laminar flow (d), quasi-laminar flow (e), and turbulent flow (f).

FIGS. 4*a-c* are graphs representative of thermal profiles of fluids exhibiting (a) laminar flow, (b) quasi-laminar flow, and (c) turbulent flow. In FIGS. 4*a*, 4*b*, and 4*c*, the y-axis is temperature and the x-axis is location along the conduit. In FIGS. 4*a*, 4*b*, and 4*c*, the bottom line of the graph represents the temperature measured at or near the center of the conduit, the top line of the graph represents the temperature measured at or nearer the wall of the conduit, and the middle line represents the temperature measured at a distance intermediate between the center and the wall of the conduit.

FIGS. 4*d-f* are graphs representative of flow velocity profiles of fluids exhibiting (d) laminar flow, (e) quasi-laminar flow, and (f) turbulent flow. The y-axis in these graphs represents distance from the center axis of the conduit, with increasing y values representing a portion of the fluid closer to the wall of the conduit. As shown by the graphs in FIGS. 4*d*, 4*e*, and 4*f*, a fluid having higher viscosity and a more laminar flow will have more variation in viscosity over a cross-section of conduit than a low viscosity fluid with a turbulent flow. For a fluid having high viscosity and laminar flow, the fluid in the center of the conduit flows at a significantly higher velocity than the fluid nearer the wall of the conduit (FIG. 4*d*). That difference in velocity lessens as the flow becomes quasi-laminar (FIG. 4*e*) and is almost negligible for a lower viscosity liquid with a turbulent flow (FIG. 4*f*).

Figure 5:
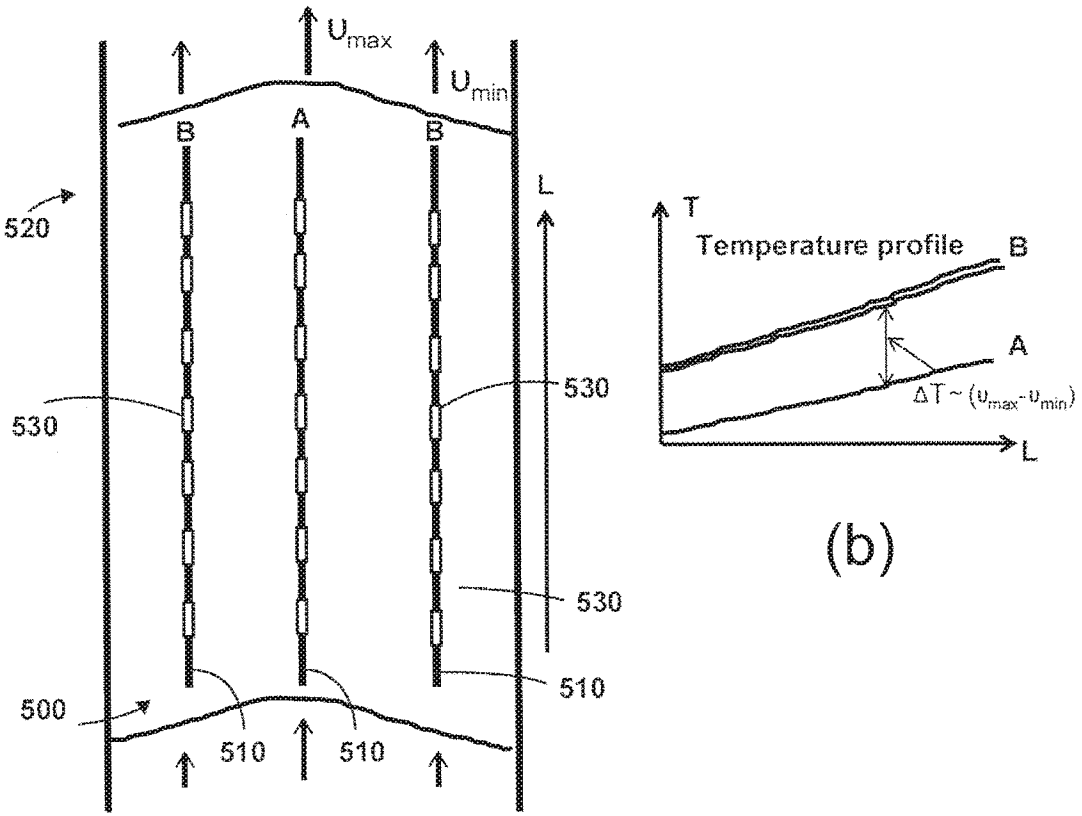
FIG. 5*a* is an illustration of an embodiment of a thermal sensor array as described herein located in a fluid flowing through a conduit.
FIG. 5*b* is a graph representative of a thermal profile of the fluid illustrated in FIG. 5*a*.

FIG. 5*a* is an illustration of an embodiment of a thermal sensor package 500 including three thermal sensing arrays 510, each including a plurality of thermal sensors 530, as described herein located in a fluid flowing through a conduit 520. The fluid flows vertically from the bottom to the top of the conduit 520. The fluid exhibits laminar flow. In laminar flow, the flow in vicinity of thermal sensing array 510 A is faster than the flow in the vicinity of thermal sensing arrays B.

FIG. 5*b* is a graph representative of the thermal profile of the fluid illustrated in FIG. 5*a*. As shown in FIG. 5*b*, the temperature detected by thermal sensing array A does not rise as much as the temperature detected by thermal sensing array B because the fluid in the center of the conduit 520 moves faster than the fluid closer to the walls. The difference in temperature between thermal sensors A and B measured at any location along the conduit is proportional to the difference in velocity of the fluid at that location.

Figure 6:
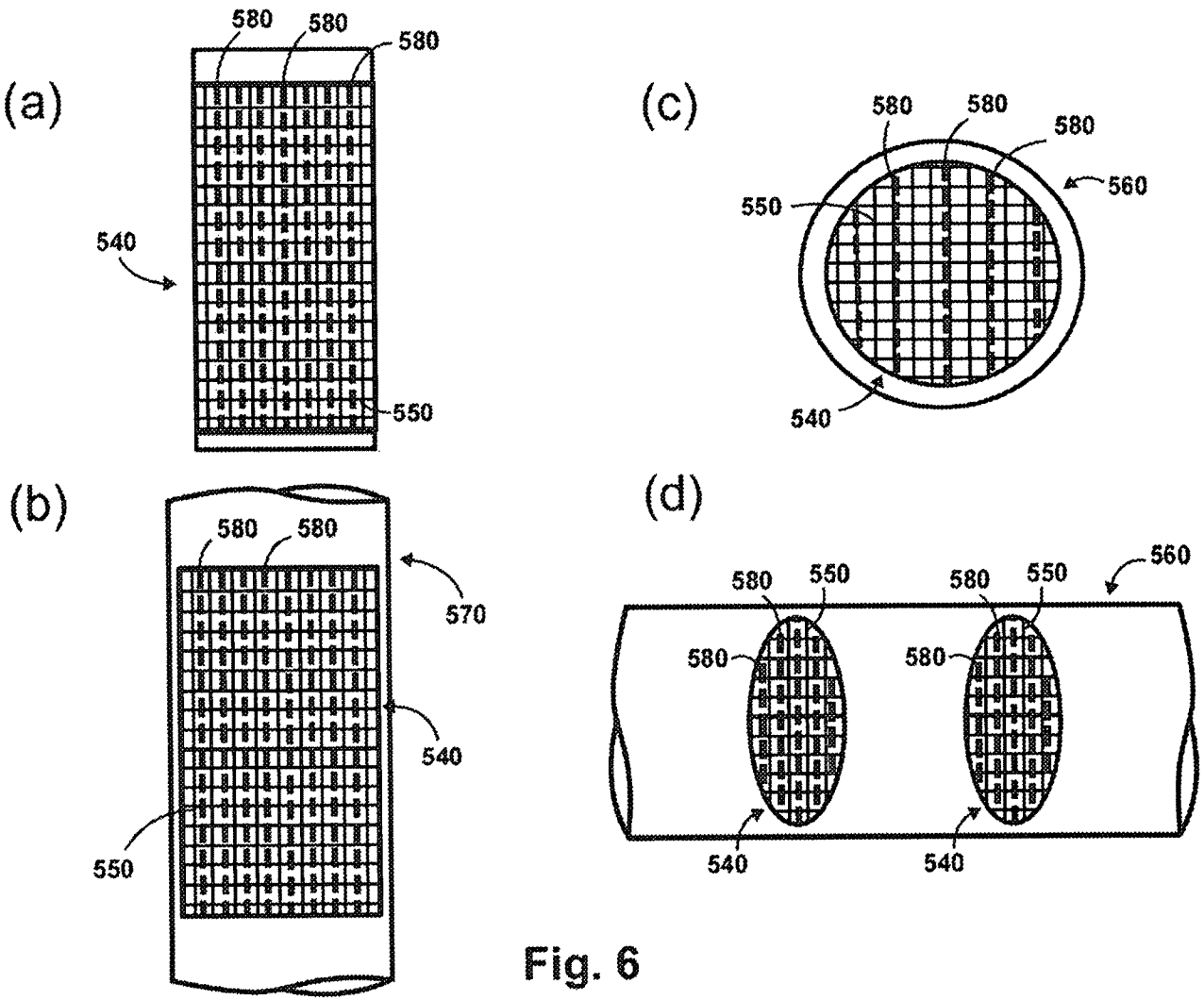
FIG. 6(*a*)-(*d*) are illustrations of embodiments of sensing arrays integrated with grid frames and installed in conduits.

FIG. 6 illustrates embodiments of sensor packages 540 as disclosed herein on heating wire grid frames 550 and inserted into horizontal conduits 560 and vertical conduits 570, either aligned with the direction of bulk fluid flow, FIG. 6*b*, or perpendicular to the direction of bulk fluid flow, FIG. 6*c*-6*d*. FIG. 6*a* illustrates a sensor package 540 constructed by forming a heating wire grid frame 550 and integrating a thermal sensing array 580 with the heating wires 550. FIG. 6*b* illustrates the sensor of FIG. 6*a* inserted into a circular vertical conduit 570 so that the thermal sensing arrays 580 are parallel to the direction of bulk fluid flow. FIG. 6*c* illustrates a cross section of a horizontal conduit 560 with a sensor package 540 inserted perpendicular to the direction of bulk fluid flow, and FIG. 6*d* illustrates a section of horizontal conduit 560 with two sensor packages 540 inserted perpendicular to the direction of bulk fluid flow and parallel to each other.

Figure 7:
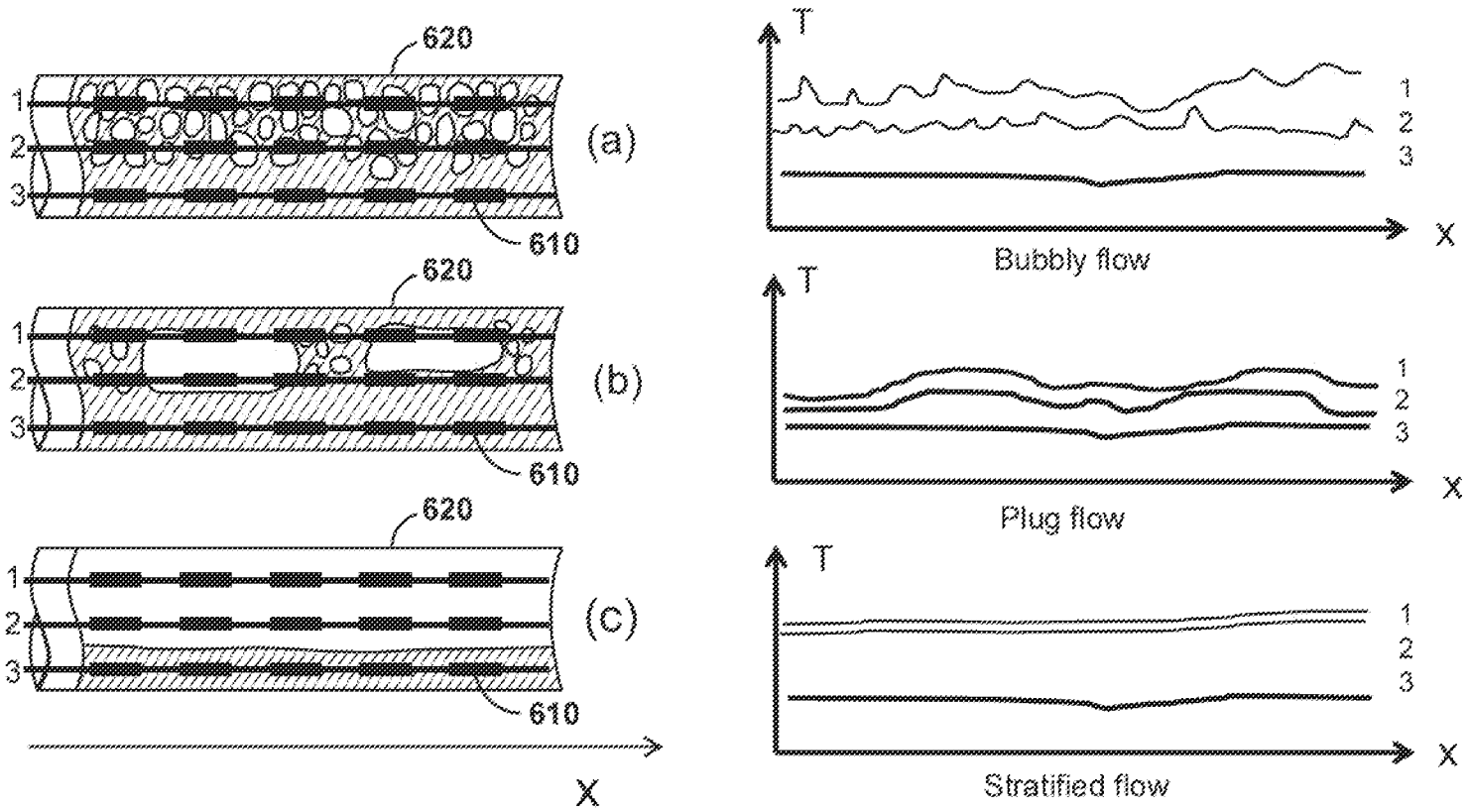
FIG. 7 (*a*)-(*f*) are illustrations of several horizontal flow patterns and typical corresponding sensor thermal responses.
Figure 7:
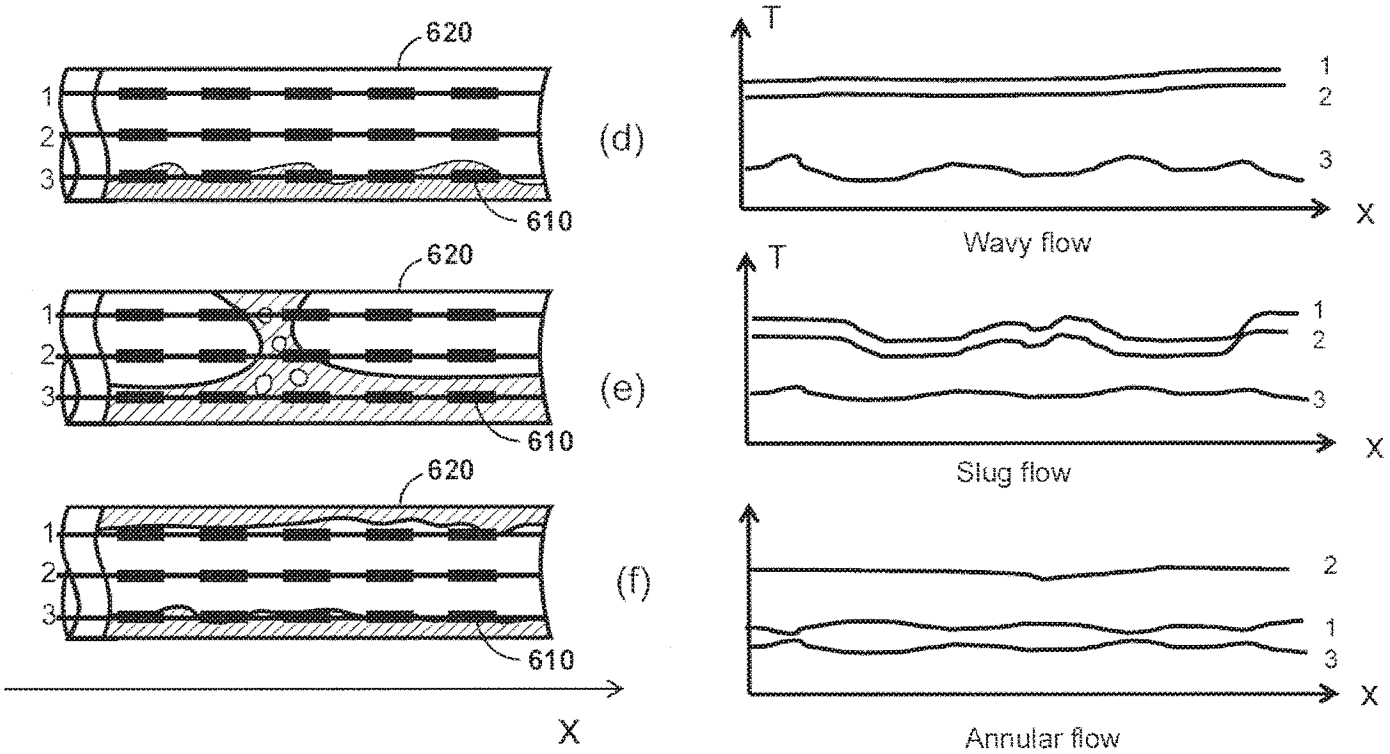

FIG. 7 illustrates embodiments of a thermal sensing arrays 610 installed in horizontal conduits 620 and examples of transient temperature responses that would be expected for each of a variety of flow patterns of multi-phase fluids. The thermal responses from vertical installed sensors will be similar to these except for the stratified and wavy flow cases. A pre-calibrated sensor thermal response characteristic, corresponding to different flow patterns, should be used for data interpretation. Thus, a person skilled in the art would be able to use a transient temperature response to interpret flow velocity through a conduit and determine whether flow is multi-phase and what type of multi-phase flow is likely to be present.

Multi-phase downhole fluid flow velocity field distribution is strongly dependent upon the multi-phase fluid flow formation properties. Different flow velocities from different phases may lead to laminated flow, Stokes flow, and even turbulent flow. Different flow velocities also are related to other thermo-physical fluid properties, such as but not limited to viscosity, hydrocarbon molecular weight, and density. Conventional flow velocity measurement, from Venturi or differential pressure sensors are related to volumetric flow velocity and cannot be used to map flow field profile. Thus, they provide low accuracy and low reliability for multi-phase flow measurements.

Devices, systems, and methods described herein provide more information about flow than is available from current velocity measurement devices. Moreover, devices described herein may be connected to a computer interface, thus the velocity profile information is available in real time. Real time analysis enables a user to view and understand flow changes throughout a conduit as they occur. Moreover, the devices, systems, and methods described herein use relative measurements to track changes in temperature of fluid flow and thereby eliminate issues associated with measuring and relying on absolute values. Consequently, the devices, systems, and methods described herein provide a differential detection method for in-situ calibration.

The multi-point temperature differences detected by the thermal sensing arrays will enable an understanding of the flow field distribution occurring within the pipeline or wellbore casing more complete than simple flow volumetric measurements.

What is claimed is:

1. A sensing system for analyzing a fluid profile and flow field distribution, the sensing system comprising a sensor package comprising a plurality of heating devices spaced apart from each other and aligned parallel to each other; and at least three thermal sensing arrays, wherein each thermal sensing array comprises a plurality of thermal sensors aligned linearly along a length of the array, and wherein the at least three thermal sensing arrays are aligned with their lengths adjacent to, spaced apart from, and parallel to each other and parallel to the plurality of heating devices.

2. The sensing system of claim 1, wherein the plurality of heating devices is connected to a pulse modulated electric current.

3. The sensing system of claim 1, wherein the plurality of heating devices lie in a single plane.

4. The sensing system of claim 1, wherein the at least three thermal sensing arrays are connected to a signal processing unit.

5. The sensing system of claim 3, wherein the at least three thermal sensing arrays lie in a single plane that is either the same plane as the plurality of heating devices or parallel to the plane of the plurality of heating devices.

6. The sensing system of claim 5, wherein the sensor package is a first sensor package comprising a first plurality of heating devices in a first heating device plane and a first at least three thermal sensing arrays in the same plane or in a plane parallel to the first heating device plane, wherein the sensing system further comprises a second sensor package comprising a second plurality of heating devices and a second at least three thermal sensing arrays, wherein each of the second at least three thermal sensing arrays comprises a plurality of thermal sensors aligned linearly along a length of the array, wherein the second plurality of heating devices and the second at least three thermal sensing arrays are aligned parallel to each other, wherein the second plurality of heating devices lies in a second heating device plane, wherein the second at least three thermal sensing arrays lies in the second heating device plane or in a plane parallel to the second heating device plane, and wherein the first heating device plane and second heating device plane are different planes.

7. The sensing system of claim 6, wherein the second heating device plane is orthogonal to the first heating device plane.

8. The sensing system of claim 1, wherein the heating devices form a sensing array grid, and wherein the thermal sensing arrays are integrated with the thermal conductive grid.

9. The sensing system of claim 1, wherein each heating device is coated with at least one layer of electric insulation, but thermally conductive material.

10. The sensing system of claim 1, further comprising a housing surrounding the sensor package, wherein the housing is open at opposite ends to allow fluid flow through the housing.

11. The sensing system of claim 10, wherein the housing is located inside a conduit.

12. A method of analyzing fluid flow across a conduit, the method comprising:

(a) raising a temperature of a plurality of heating devices, wherein the plurality of heating devices is located in a fluid having a bulk flow in a single direction, and wherein the heating devices are oriented parallel to each other and are aligned with the direction of the bulk fluid flow;

(b) detecting multi-point temperatures with at least three thermal sensing arrays, wherein each thermal sensing array comprises a plurality of thermal sensing devices aligned linearly along a length of the thermal sensing array, wherein the at least three thermal sensing arrays are located in the fluid, and wherein the at least three thermal sensing arrays are oriented with their lengths adjacent to, spaced apart from, and parallel to each other and aligned with the direction of the bulk fluid flow; and (c) using the multi-point temperatures to determine a dynamic temperature response profile across a conduit.

13. The method of claim 12, wherein detecting the multi-point temperatures and using the multi-point temperatures to determine a dynamic temperature profile comprises sending a plurality of signals from the plurality of thermal sensing arrays to a signal processing unit and displaying the dynamic temperature profile.

14. The method of claim 13, wherein the dynamic temperature profile is displayed in real time.

15. The method of claim 12, wherein the dynamic temperature profile includes a temperature response slope for each of the plurality of thermal arrays, and wherein the method further comprises using the temperature response slopes to determine a flow velocity profile.

16. The method of claim 12, wherein raising the temperature of the plurality of devices comprises applying a pulse modulated current to the devices.

17. The method of claim 12, wherein measuring multi-point temperatures comprises measuring a transient thermal response.

18. The method of claim 12, wherein determining a dynamic temperature profile comprises determining an axial dynamic temperature profile.

19. The method of claim 12, wherein determining a dynamic temperature profile comprises determining a radial dynamic temperature profile.

20. The method of claim 12, further comprising determining a fluid flow pattern.

21. The sensing system of claim 1, wherein the heating devices are heating wires.

22. The method of claim 12, wherein the heating devices are heating wires.

* * * * *